US007288033B1

(12) United States Patent
Jordan

(10) Patent No.: US 7,288,033 B1
(45) Date of Patent: Oct. 30, 2007

(54) QUARTERBACK TOSS TARGET

(76) Inventor: Christopher Jordan, 1201 S. Douglas, Midwest City, OK (US) 73130

( * ) Notice: Subject to any disclaimer, the term of this patent is extended or adjusted under 35 U.S.C. 154(b) by 176 days.

(21) Appl. No.: 11/318,773

(22) Filed: Dec. 27, 2005

(51) Int. Cl.
*A63B 69/00* (2006.01)

(52) U.S. Cl. ..... 473/439; D21/705

(58) Field of Classification Search ..... 473/439, 473/446, 440–444, 438, 422; 43/2, 3; D21/705
See application file for complete search history.

(56) References Cited

U.S. PATENT DOCUMENTS

| | | | | |
|---|---|---|---|---|
| 2,203,259 | A * | 6/1940 | Gilman | 473/444 |
| 2,237,599 | A * | 4/1941 | Gilman | 473/444 |
| 2,937,872 | A | 5/1960 | Gilman | |
| 3,391,936 | A * | 7/1968 | Grimes | 473/439 |
| 3,467,380 | A * | 9/1969 | Bonacci | 473/439 |
| 3,558,135 | A * | 1/1971 | Rees et al. | 473/444 |
| 3,573,867 | A * | 4/1971 | Mehrens | 473/439 |
| 3,680,862 | A * | 8/1972 | Russell et al. | 473/439 |
| 3,823,939 | A * | 7/1974 | Bottorff | 473/439 |
| 3,929,334 | A | 12/1975 | Magazzu | |
| 4,770,412 | A * | 9/1988 | Wolfe | 482/85 |
| 4,936,578 | A * | 6/1990 | Hudson, Sr. | 473/439 |
| 5,037,095 | A | 8/1991 | Nedwick | |
| 5,335,906 | A * | 8/1994 | Delker | 473/444 |
| D371,587 | S | 7/1996 | Braun | |
| 6,736,738 | B1 | 5/2004 | Taa | |

* cited by examiner

*Primary Examiner*—Eugene Kim
*Assistant Examiner*—M. Chambers
(74) *Attorney, Agent, or Firm*—Randal D. Homburg

(57) ABSTRACT

A portable football target device for improving the accuracy of a pass and to also teach defensive backs the appropriate decision to make when covering a receiver as to whether to attempt an interception or to tackle the receiver, includes a rounded weighted base attached to an upper padded contact member within which is located an internal support tube array providing a plurality of spacial target rod receptacles within which is placed one or more netted target members, providing at least one target at a location relative to the device to which a pass may be thrown with the football being retained within the netted target member.

6 Claims, 2 Drawing Sheets

QUARTERBACK TOSS TARGET

CROSS REFERENCE TO RELATED APPLICATIONS

None

I. BACKGROUND OF THE INVENTION

1. Field of Invention

A portable football target device for improving the accuracy of a pass and to also teach defensive backs the appropriate decision to make when covering a receiver as to whether to attempt an interception or to tackle the receiver, includes a rounded weighted base attached to an upper padded contact member within which is located an internal support tube array providing a plurality of spacial target rod receptacles within which is placed one or more netted target members, providing at least one target at a location relative to the device to which a pass may be thrown with the football being retained within the netted target member.

2. Description of Prior Art

The following United States patents were discovered and are disclosed within this application for utility patent. All relate to football target devices and tackling dummies.

It has been long known in the art that a tackling dummy generally includes an external covering with a heavy material loaded within a base portion with the upper portion filled with air or some other expandable material, the upper portion intended for contact or tackling practice, as indicated in U.S. Pat. Nos. 2,937,872 and 2,237,599 to Gilman. Both of these devices are self-erecting, indicating that when these objects are hit, they return to an upright position for the next contact. These devices are used to teach proper tackling technique in non-game practices to simulate tackling of a football player during a game. Their sole purpose is for contact drills.

Several other devices are used in football practices for training a quarterback to throw a football accurately. In U.S. Pat. No. 6,736,738 to Taa, a base member is attached to an upright member, the base member either being embodied as a flat weighted base retaining the device in an upright position without movement, or a rounded weighted base which allows the device to pivot. The upright portion of this device includes a cavity including holes which allow the football to pass through the holes and retained in the cavity, as well as being provided with a basket attached between two arms which are extended wither over the device, or somewhat behind the device.

A single netted target on a pipe frame is disclosed in U.S. Design Pat. No. D371,587 to Braun and U.S. Pat. No. 3,929,334 to Magazzu, which are supported by the ground. U.S. Pat. No. 5,037,095 to Nedwick has a netted target device suspended from a horizontal pole above the ground, shown supported by a goalpost cross member. A multiple target device is disclosed in U.S. Pat. No. 4,936,578 to Hudson, Sr., Providing upper or lower positional rings on the outer ends of the target cross member support, and a lower ring integrated within the vertical support member having a base with an adjustable height upper ring telescoping within the vertical support member.

Another target device portrays a football player dummy mounted on a moving cart which is controlled by a drive mechanism and a remote steering device, the football player dummy having positional arms supporting a basket into which a football is thrown which the device rolls about the football field.

None of these target devices include a support member suited for moderate contact while also provided with a multiple positioned target net or a plurality of target nets in multiple positions for simultaneously providing a training device for both quarterbacks and defensive backs to teach passing and pass coverage for football players.

II. SUMMARY OF THE INVENTION

In the game of football, numerous devices are provided in the prior art to teach throwing techniques to a quarterback. Simple devices, such as an automobile tire, have been used to teach a quarterback to throw a football with improved accuracy and speed. These devices generally train a quarterback to throw to a single location, which is repetitious and not conducive to a game setting, because a receiver does not remain stationary, and a pass may need to be thrown to several different locations to a receiver depending on the immediate coverage of that receiver. Sometimes the football is best thrown low and outside and sometimes the ball is best thrown directly overhead, or at any location between.

At the same time, a defensive back providing defensive coverage to a receiver must be trained to respond to the receiver in a manner which sometimes involves a decision to either attempt to intercept a pass or focus on tackling the receiver after the catch. Again, since receivers are not supposed to remain stationary, the defensive back must be trained to make split second decisions based upon where the receiver is to catch the ball, and the position to which the ball is thrown to the receiver, either high or low or inside or outside.

It would be desirable to provide a single device that allows a quarterback to throw at a variety of locations on a single target during live coverage by a defensive back without risk of injury to a receiver, providing a device with multiple target to throw to while training a defensive back to cover the receiver and decide between covering the receiver or attempting an interception while the football is thrown.

III. DESCRIPTION OF THE DRAWINGS

The following drawings are submitted with this utility patent application.

IV. DESCRIPTION OF THE PREFERRED EMBODIMENT

Figure 1:
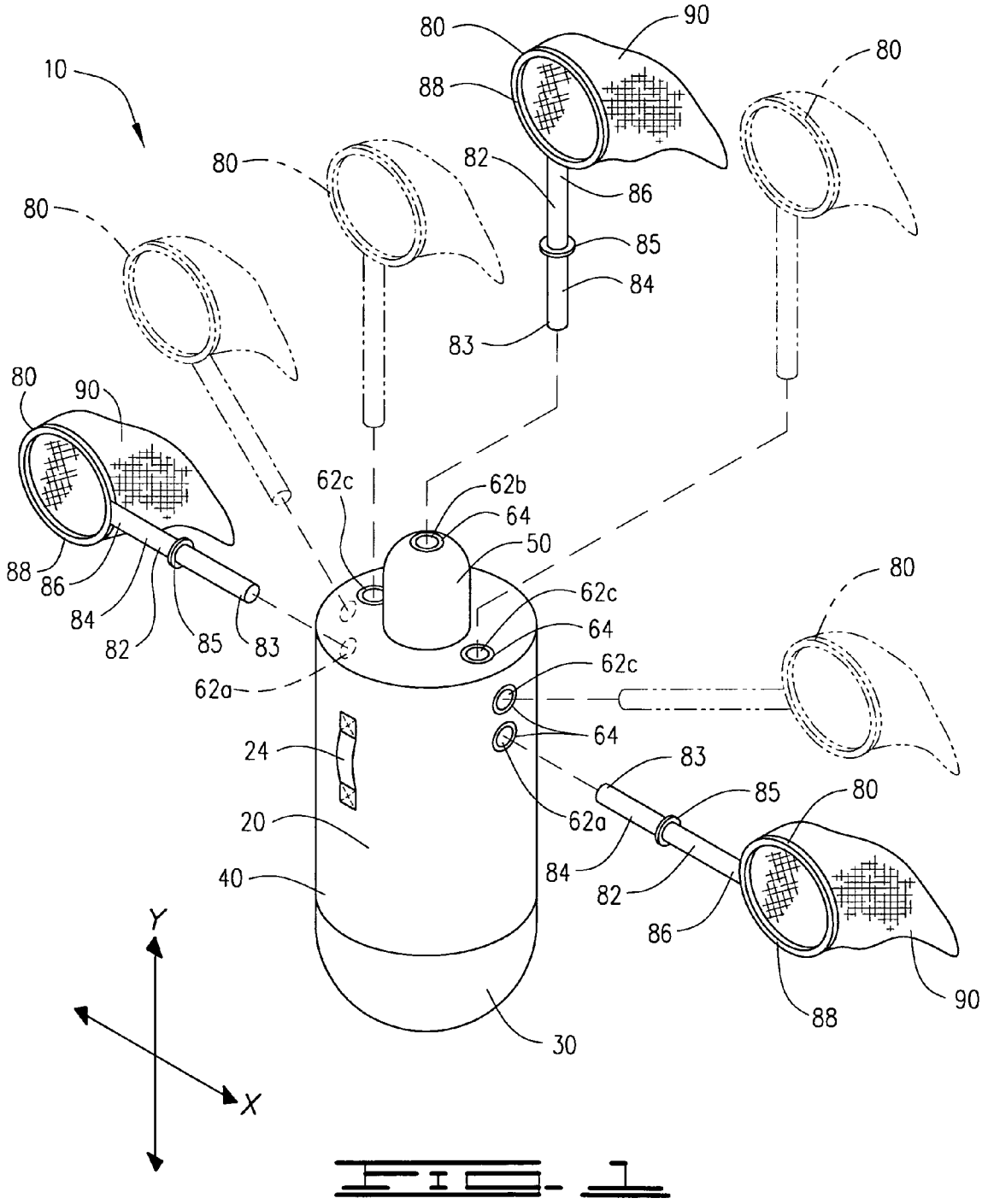
FIG. 1 is a perspective view of the target device showing the multiple placements of the target nets.
Figure 3:
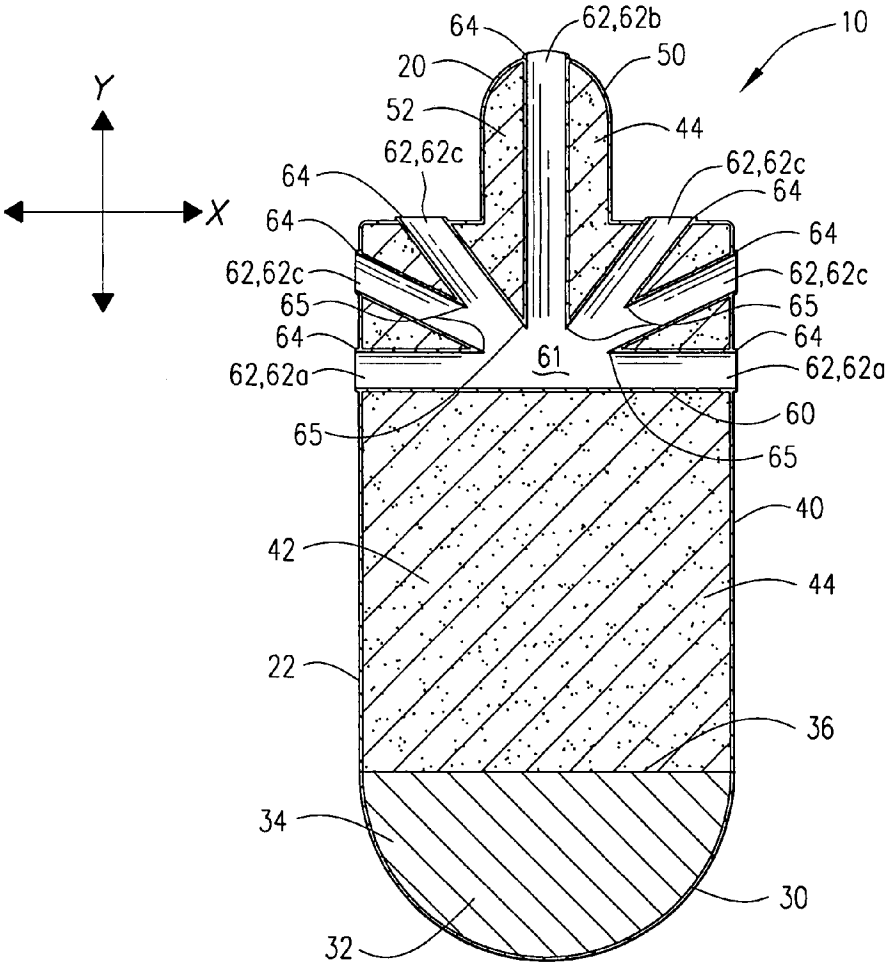
FIG. 3 is a front view of the base member of the target device.
Figure 2:
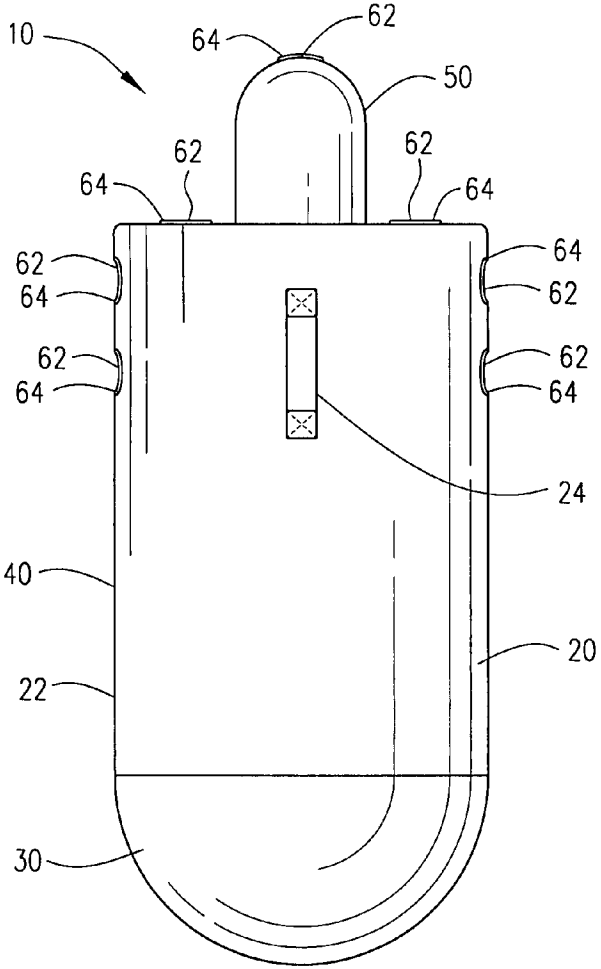
FIG. 2 is a front cross-sectional view of the base member of the target device.

A football training device 10 for improving accuracy of a quarterback throwing a football and providing a defensive back on receiver coverage technique, the device 10 shown in FIGS. 1-3 of the drawings, comprises a durable fabric outer cover 20 having an outer surface 22, the outer cover 20 defining a rounded bottom portion 30 having a first cavity 32 filled with a weighted material 34, an upright body portion 40, having a second cavity 42 filled with an expandable padded material 44 and a head portion 50 having a third cavity 52 also filled with an expandable padded material 44 set above of the upright body portion 40, the second cavity 42 and third cavity 52 containing an internal tubular support array 60 comprising a plurality of angular tubes 62 having a reinforced outer margin 64 attached to the outer surface 22, and at least one target member 80 comprising a support post 82 defining a first end 83, a shaft 84 with an intermediate support post retaining ring 85, and a second end 86 defining a target hoop 88, the target hoop 88 having a retaining net 90 to retain a football thrown through the target hoop 88, the first end 83 of each of the at least one target member 80 inserted within an outer margin 64 into a corresponding angular tube 62.

The internal tubular support array 60, shown in FIG. 3, further comprises the plurality of angular tubes 62 having a terminal end 65 defining a common intersecting chamber 61, with two horizontal angular tubes 62*a* connected together and extending through the upright body portion 40 to form a horizontal axis X which is perpendicular to the erect device seated upon the ground on the rounded bottom portion 30, one vertical angular tube 62*b* perpendicular to the two horizontal angular tubes 62*a*, extending through the head portion 50 in a vertical axis Y when the device is seated upon the ground on the rounded bottom portion 30, and intermediary angular tubes 62*c* placed between the horizontal angular tubes 62*a* and the vertical angular tube 62*b*, with all the angular tubes having a common plane. The internal tubular support array 60 is surrounded by the expandable padded material 44 within the second and third cavities 42, 52. It is preferred that the first cavity 32 and second cavity 42 are separated by a cavity barrier 36 to maintain segregation of the weighted material 34 from the expandable padded material 44.

In a preferred embodiment, the outer surface 22 of the outer cover 20 would included a reinforced fabric handle 24, FIGS. 1-2, to assist in transporting the device. Also, in a preferred embodiment, shown in FIG. 1, the device includes up to seven target members 80 which may be placed within seven angular tubes 62 providing at least seven targets in which to throw a football, the target members 80 simulating at least seven positions of a receiver with their arms extended to catch a pass thrown by a quarterback.

The outer cover 20 would preferably be made with an impact resistant durable fabric material which would withstand moderate impact from a defensive back striking the device during simulated pass coverage drills. Canvas with an outer rubberized coating or an impact resisting nylon would be suitable fabrics with which to make the outer cover 20. The expandable padded material 44 within the second and third cavities 42, 52 should be a resilient foam material which would apply force to the outer cover 20 to maintain a pre-shape of the device, yet absorb impact which would slightly deform the shape of the device during impact and return the device to a pre-impact shape.

Similarly preferred, the support post 82 of the at least one target member 80 should possess the physical ability to bend or flex, but not break, in the event the moderate impact with the target member 80 or the upright body portion 40 by a defensive back causing the target member 80 to make incidental forceful contact with the ground during drills. In this regard, at least the shaft 84 of the support post 82 would either have a flexible joint or a flexible portion, not shown.

While the football training device has been particularly shown and described with reference to a preferred embodiment thereof, it will be understood by those skilled in the art that changes in form and detail may be made therein without departing from the spirit and scope of the invention.

What is claimed is:

1. A football training device for improving the throwing accuracy of a quarterback throwing a football and improving coverage technique by a defensive back on receiver comprising:

an integrated fabric outer cover having an outer surface, said outer cover defining a rounded bottom portion having a first cavity filled with a weighted material, an upright body portion, having a second cavity containing an expandable padded material and a head portion having a third cavity containing an expandable padded material set on top of the upright body portion;

an internal tubular support array affixed within said second and third cavity, said internal tubular array further comprising a plurality of angular tubes having a reinforced outer margin attached to said outer surface; and at least one target member defining a support post having a first end, a shaft with an intermediate support post retaining ring, and a second end defining a target hoop, said target hoop having a retaining net to retain a football thrown through said target hoop, said first end of each said at least one target member inserted within said outer margin into a selected said plurality of angular tubes.

2. The football training device, as disclosed in claim 1, said internal tubular support array further comprising:

each said plurality of angular tubes having a terminal end defining a common intersecting chamber;

two horizontal angular tubes having said terminal ends connected together and extending through said upright body portion to form a horizontal axis;

one vertical angular tube perpendicular to said two horizontal angular tubes extending through the head portion in a vertical axis; and intermediary angular tubes placed between the horizontal angular tubes and the vertical angular tube, said internal tubular support array surrounded by said expandable padded material within said second and third cavities.

3. The football training device, as disclosed in claim 1, said first cavity and said second cavity separated by a cavity barrier maintaining segregation of said weighted material from said expandable padded material and said outer surface of said outer cover having a reinforced fabric handle grasped during transport of the device.

4. The football training device, as disclosed in claim 1, having seven target members placed within seven angular tubes in said internal tubular support array providing said seven target members in which to throw a football.

5. The football training device, as disclosed in claim 1, further comprising:

said outer cover is an impact resistant durable fabric material withstanding repetitive moderate impact;

said expandable padded material within the second and third cavities is a resilient foam material applying an outward force to said outer cover and absorbing impact; and said support post of said at least one target member adapted to bend or flex, but not break, upon moderate impact to said target member or an incidental forceful contact of said target member with the ground.

6. The football training device, as disclosed in claim 1, said internal tubular support array further comprising:

each said plurality of angular tubes having a terminal end defining a common intersecting chamber;

two horizontal angular tubes having said terminal ends connected together and extending through said upright body portion to form a horizontal axis;

one vertical angular tube perpendicular to said two horizontal angular tubes extending through the head portion in a vertical axis;

intermediary angular tubes placed between the horizontal angular tubes and the vertical angular tube, said internal tubular support array surrounded by said expandable padded material within said second and third cavities;

said first cavity and said second cavity being separated by a cavity barrier maintaining segregation of said weighted material from said expandable padded material and said outer surface of said outer cover having a reinforced fabric handle grasped during transport of the device;

said outer cover is an impact resistant durable fabric material withstanding repetitive moderate impact;

said expandable padded material within the second and third cavities is a resilient foam material applying an outward force to said outer cover and absorbing impact; and said support post of said at least one target member adapted to bend or flex, but not break, upon moderate impact to said target member or an incidental forceful contact of said target member with the ground.

* * * * *